US005647714A

United States Patent [19]

Lundberg

[11] Patent Number: 5,647,714

[45] Date of Patent: Jul. 15, 1997

[54] AUTOMATIC REGISTER CUTTING METHOD AND AN AUTOMATIC REGISTER CUTTER FOR CARRYING OUT THE METHOD

[76] Inventor: Jan Lundberg, Trastgatan 10, S-941 21 Piteå , Sweden

[21] Appl. No.: 374,504

[22] PCT Filed: Jun. 23, 1993

[86] PCT No.: PCT/SE93/00559

§ 371 Date: Mar. 13, 1995

§ 102(e) Date: Mar. 13, 1995

[87] PCT Pub. No.: WO94/02332

PCT Pub. Date: Feb. 3, 1994

[30] Foreign Application Priority Data

Jul. 20, 1992 [SE] Sweden ..... 9202206

[51] Int. Cl.[6] ..... B42B 9/00

[52] U.S. Cl. ..... 412/1; 412/16

[58] Field of Search ..... 412/16, 1, 14, 412/9; 83/239, 904

[56] References Cited

U.S. PATENT DOCUMENTS

| | | | |
|---|---|---|---|
| 2,078,656 | 4/1937 | Erickson | 83/904 |
| 2,187,827 | 1/1940 | Eickman | 83/239 X |
| 2,489,825 | 11/1949 | Sieb . | |
| 2,763,324 | 9/1956 | Loverch et al. . | |
| 3,250,162 | 5/1966 | Bunting | 412/16 X |
| 4,484,501 | 11/1984 | Ramcke | 412/16 X |

*Primary Examiner*—Willmon Fridie, Jr.

*Attorney, Agent, or Firm*—John Lezbey & Associates

[57] ABSTRACT

The present invention relates to a method of automatically cutting indexes and an automatic index cutting machine for carrying out the method. The index cutting machine is constructed of number of modules where each module includes a counting arrangement which functions to count a predetermined number of pages automatically for a specific index indentation, and a knife arrangement for cutting this predetermined number of pages. The book is transported between the modules hanging from a transporting arrangement which includes a transporter to hold the book hanging from its spine. Each module counts up to an index indentation and the index indentation is then cut in the knife arrangement, whereafter the book is transported to the next module in which a count is made to the next index indentation and this index indentation is cut. This procedure is repeated module after module.

6 Claims, 3 Drawing Sheets

AUTOMATIC REGISTER CUTTING METHOD AND AN AUTOMATIC REGISTER CUTTER FOR CARRYING OUT THE METHOD

BACKGROUND OF THE INVENTION

1. Field of the Invention

The present invention relates to a method of automatically cutting book indexing indentations and an automatic index cutting machine for carrying out the method.

2. Description of the Prior Art

Present-day machines which cut indexing indentations or index tabs in pages that are larger than A5 are semiautomatic. A greater part of the work with these index cutting machines is effected manually. The number of pages that shall lie beneath a given index indentation or index tab are turned over by hand and then inserted manually beneath the reference. The work that is carried out automatically in such semiautomatic index cutting machines is the work of cutting an index indentation and re-adjustment to the next following index indentation. These procedures are carried on a book that lies flat on a supportive surface. The drawbacks with such semi-automatic index cutting machines is that they require a work force to carry out the manual procedures and that production is relatively low.

SUMMARY OF THE INVENTION

These drawbacks are eliminated by the inventive automatic index cutting machine and automatic index cutting method having the characteristic features set forth in the characterizing clause of claim 1 and claim 6 respectively. The inventive index cutting machine is constructed of modules, where each module includes a counter which automatically counts a predetermined number of pages for a specific index indentation, and knife means for cutting said predetermined number of pages. The book is transported between the modules while hanging from a transportation device. In each module, a count is made up to the page on which an index or reference indentation is to be made and the page is then cut in the knife arrangement, whereafter the book is transported to the next module where a count is made to the intended place of the next index indentation and this page is cut, this procedure being repeated in module after module.

The present invention will now be described in more detail with reference to an exemplifying embodiment thereof and also with reference to the accompanying drawings.

DESCRIPTION OF THE PREFERRED EMBODIMENTS

Figure 1:
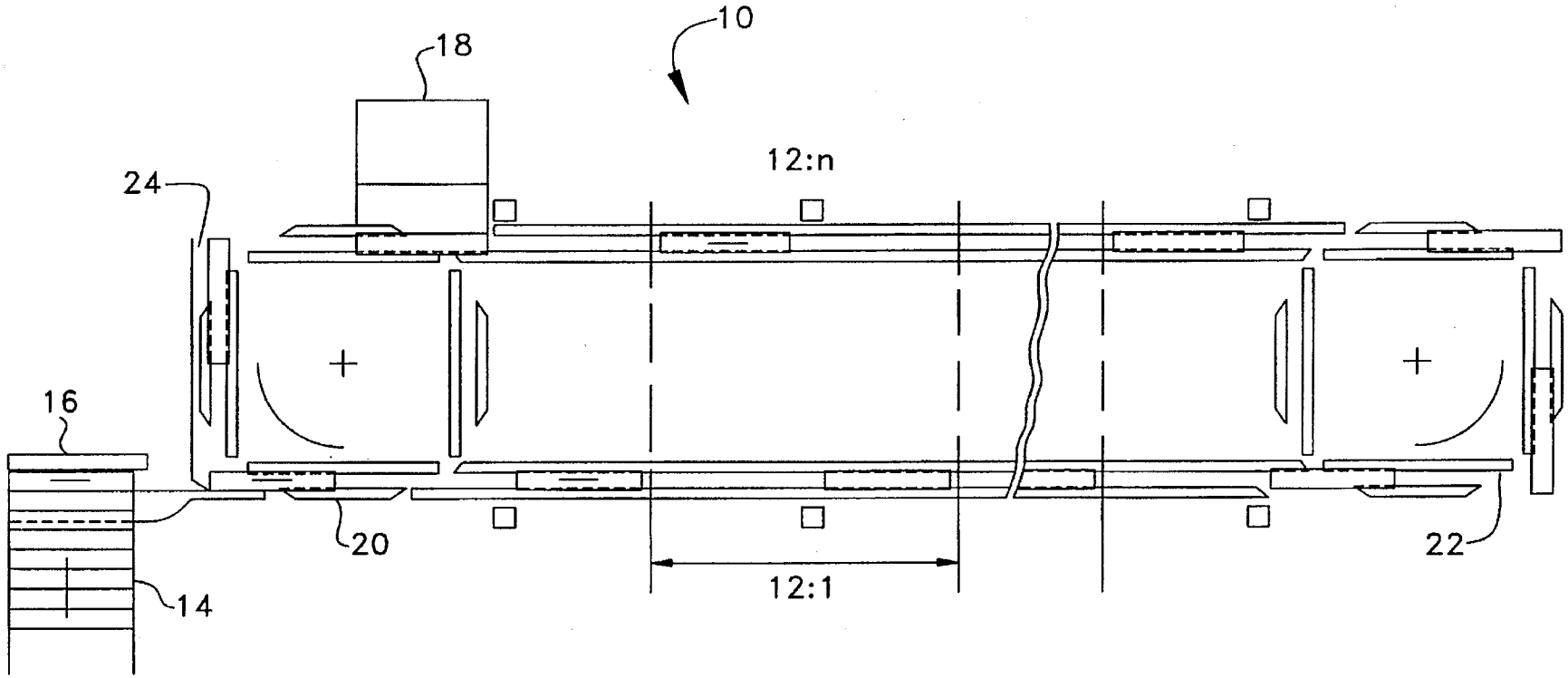
FIG. 1 is a schematic elevation of one embodiment of the inventive automatic index cutting machine.
Figure 2:
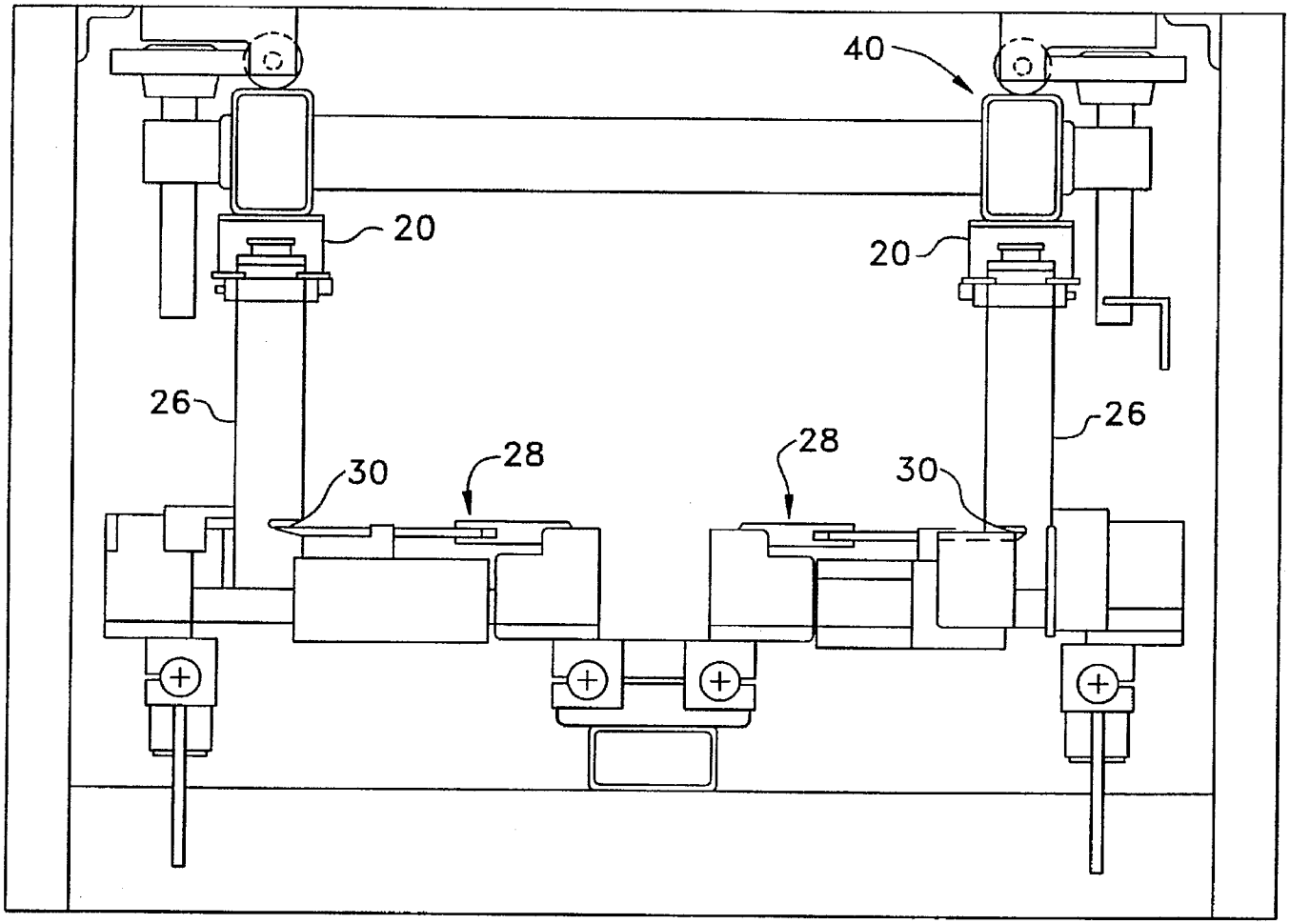
FIG. 2 is a sectional view of part of the inventive automatic index cutting machine shown in FIG. 1.

The exemplifying embodiment of the inventive automatic index cutting machine or index cutting machine 10 illustrated in FIGS. 1 and 2 includes a number (n) of modules 12:1–12:n, where each module 12:1–12:n includes a counter (see FIG. 3) and a knife arrangement 28. The index cutting machine 10 also includes a book storage means 14 for books 26 and an infeed means 16 which functions to feed one book 26 at a time from the storage means 14 to a transporter 20 which forms part of a transportation arrangement 40 and firmly holds the book 26 by its spine. The cutter 10 also includes an outfeed means 18 which discharges the processed books from the indexing machine, i.e. books in which all index indentations or index tabs have been cut. The illustrated embodiment of the indexing machine 10 also includes a transporter switch 22 which changes the direction of movement of the transporter 20, and a return table 24 which returns the transporter 20 to the beginning of the indexing machine 10.

As shown in FIG. 2, each knife arrangement 28 includes a knife means 30, which moves linearly and which may consist of a knife blade. Although not shown, the knife is moved by means of a pneumatic piston-cylinder device which translates said movement to the knife means 30 via a link system (not shown). The knife arrangement 28 also includes a spring-biassed anvil (a clamping strip not shown) which holds the index indentation firmly at the cutting moment. It will be noted that the knife means 30 cuts in both directions of its linear movement.

Figure 3:
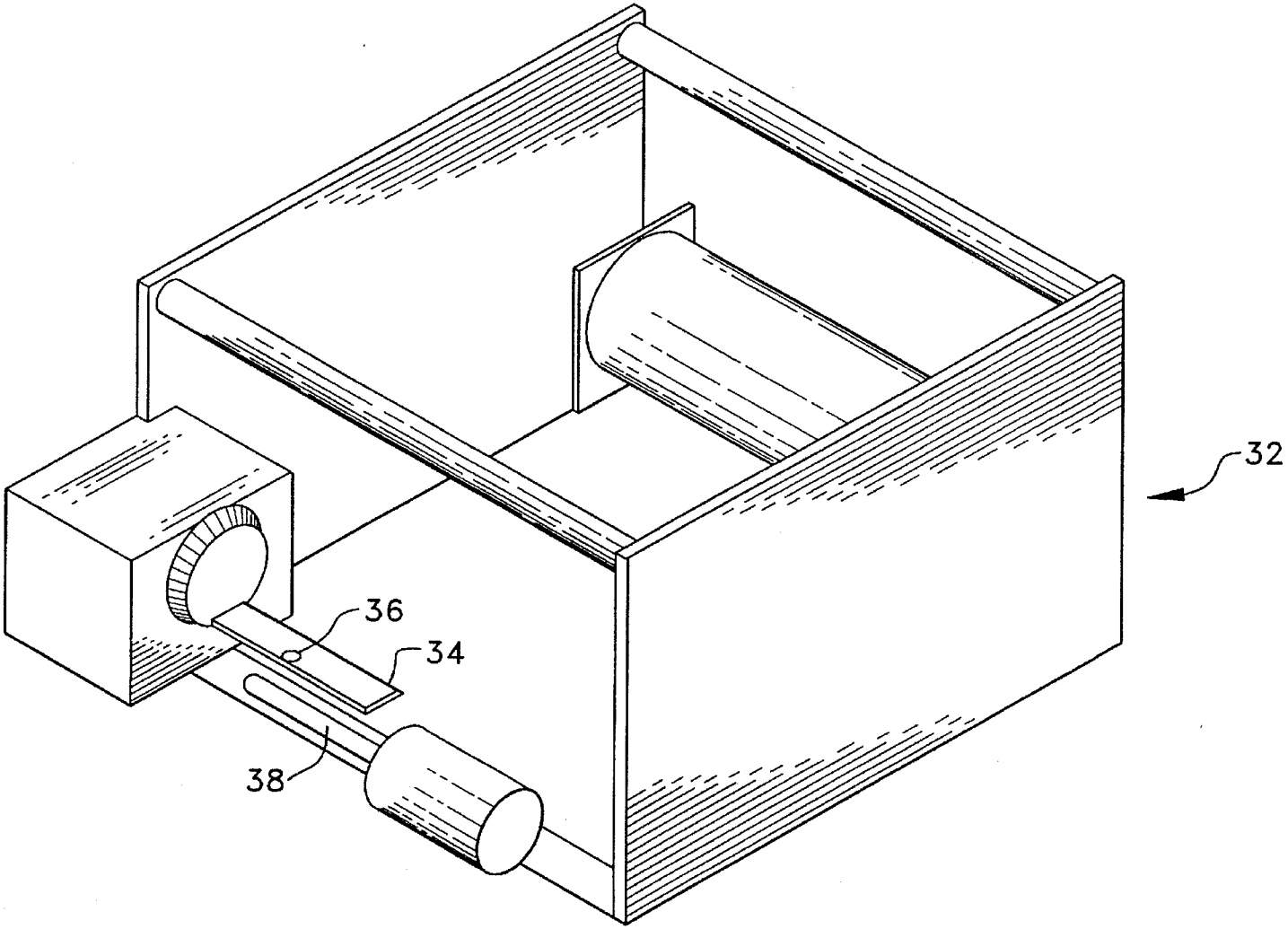
FIG. 3 is a perspective view of a counter included in the inventive automatic index cutting machine.

FIG. 3 is a perspective view of a counter 32 included in the inventive automatic index cutting machine 10. The counter 32 includes a tongue-like element 34 which oscillates backwards and forwards when activated, and a pin 38 which rotates when activated. When a book 26 is transported to a counter 32, the book 26 lies against the tongue-like element 34 and a page is sucked firmly against the element by the action of a subpressure which communicates through a small hole 36 in the tongue-like element 34. When a start signal is delivered by a control unit (not shown), both the tongue-like element 34 and the pin 38 are activated mechanically by levers from one and the same motor. When the tongue-like element 34 oscillates, the leaf or page firmly held to the element by suction is curved away from the remaining pages such as to create between the pages a space into which the pin 38 can enter. The pin 38 then carries the page adhering to the element 34 to the rear side of said element and a new page is sucked firmly onto said element 34. The vacuum system also includes a valve (not shown) which is opened and closed in dependence on the vacuum that prevails. The valve detects when a page has been sucked firmly onto the tongue-like element 34 and can thus confirm that a page has been counted. The aforesaid control unit controls the number of pages that each counter 32 is to count, i.e. the number of pages that shall be included in each index indentation. The predetermined number of pages for each individual index indentation are fed into the control unit by means of an infeed device (not shown).

The inventive automatic index cutting machine 10 operates in the following manner: Books are fed singly from the storage device 14 to the transporter 20 by means of the infeed device 16. The transporter 20 holds the book by its spine. The book hangs from the transporter 20 and is carried thereby to the first module 12:1, where the bottom cover is folded down beneath a guide by means of a suction feed. The book is then transported to the counter arrangement 32 in the first module 12:1, where a number of pages are counted in accordance with a preset program. The pages are then folded down beneath a guide and the book is transported to the knife arrangement 28, where the index indentations are cut and folded beneath the guide. The book is then transported to the next module 12:2 where a count is made up to the next index indentation and a cut is made, this procedure being repeated module for module. The books are transported in a continuous sequence, since all counter arrangements 32 and knife arrangements operate simultaneously on one book. A machine intended to cut thirty index indentations will include thirty modules. The first index indentation 1 is made in the first module 1 and the thirtieth index indentation is made in module 30. It is also possible to produce a book containing thirty index indentations in a machine that consists solely of fifteen modules, although this will halve the production rate since it is necessary to pass the book through the machine twice.

It will be understood that the aforedescribed exemplifying embodiment of the invention is merely an example of how the invention can be realized and in no way limits the invention, the scope of which is defined in the following claims.

I claim:

1. An automatic book index cutting machine comprising a plurality of modules, each module having means for counting a predetermined number of pages for a specific index indentation of the module; means for cutting the predetermined number of pages for one specific index indentation of the module; and a plurality of transporters for holding and transporting books by a spine of each book.

2. An automatic index cutting machine according to claim 1, further comprising storage means for holding the books; input means for feeding the books from the storage means to one of the transporters; and output means for feeding the books out of the machine.

3. An automatic index cutting machine according to claim 2, further comprising a programming unit connected to control means for controlling the counting means so that each counting means will count a predetermined number of pages for a specific index indentation of the module.

4. An automatic index cutting machine according to claim 3, further comprising an oscillating tongue type element having a hole in each counting means; a motor; and a rotatable pin; wherein the motor and control means oscillate the tongue type element and rotate the pin forming a vacuum through the hole in the tongue type element so that a page of the book is sucked against the tongue type element, and wherein the oscillation and rotation coact together to separate counted pages from uncounted pages.

5. An automatic index counter according to claim 4, wherein the cutting means includes spring biased anvil means for holding the pages to be cut and linearly movable knife means driven by a pneumatic piston and cylinder arrangement via a link system.

6. A method for automatically indexing and cutting books utilizing an index cutting machine, the method comprising the steps of:

a) feeding a book having a spine to a transporter located in the machine;

b) holding the book by the spine of the book when the book is in the transporter;

c) folding a cover side by using a vacuum beneath a tongue type element located in the machine;

d) transporting the book held in the transporter to a first module located in the machine;

e) counting a predetermined number of pages with counting means located in the machine, the pages corresponding to a specific index indentation of the first module, which is folded down beneath the tongue type element;

f) transporting the book to cutting means located in the first module for cutting a first index indentation;

g) transporting the book to a second module located in the machine; and h) repeating steps e)–g) a preselected number of times.

* * * * *